US007076828B2

(12) United States Patent
Hewlett

(10) Patent No.: US 7,076,828 B2
(45) Date of Patent: Jul. 18, 2006

(54) GUTTER CLEANING TOOL

(76) Inventor: Mark Philip Hewlett, 12750 Lakeshore North Dr., Auburn, CA (US) 95602

( * ) Notice: Subject to any disclaimer, the term of this patent is extended or adjusted under 35 U.S.C. 154(b) by 334 days.

(21) Appl. No.: 10/223,253

(22) Filed: Aug. 19, 2002

(65) Prior Publication Data

US 2003/0051305 A1 Mar. 20, 2003

Related U.S. Application Data

(60) Provisional application No. 60/323,915, filed on Sep. 20, 2001.

(51) Int. Cl.
*A47L 13/02* (2006.01)

(52) U.S. Cl. ..... 15/236.04; 15/104.3; 15/236.01; 15/236.05; 15/236.07

(58) Field of Classification Search ..... 15/104.3, 15/236.05, 104.05, 104.68, 236.04, 236.01, 15/236.06, 236.07; D32/46; D8/5, 10; 401/193; D15/25; D7/688
See application file for complete search history.

(56) References Cited

U.S. PATENT DOCUMENTS 3,740,787 A * 6/1973 Bowermaster ..... 15/105
4,194,780 A 3/1980 Dilley
4,304,498 A * 12/1981 George ..... 401/9
D267,357 S 12/1982 Hillstrom
4,542,553 A 9/1985 Cary
4,549,611 A 10/1985 Mills
4,848,818 A 7/1989 Smith
D310,590 S 9/1990 Williams, Jr.
D335,558 S 5/1993 Boothe
5,297,306 A * 3/1994 Shandel ..... 7/114
6,139,077 A * 10/2000 Molzan, II ..... 294/19.1
6,185,782 B1 2/2001 Hall
6,237,974 B1 5/2001 Chisholm
6,378,153 B1 * 4/2002 Morgan ..... 7/116
6,526,619 B1 * 3/2003 Cassels, Jr. ..... 15/236.04

* cited by examiner

*Primary Examiner*—Gladys J. P. Corcoran
*Assistant Examiner*—Abraham Bahta
(74) *Attorney, Agent, or Firm*—Mathew J. Temmermar; Daniel P. Maguire

(57) ABSTRACT

A gutter cleaning tool with a curved blade and a shovel blade is disclosed. The curved blade is used to collect debris in the gutter, and the shovel blade is used to push debris under a gutter strut. The present invention also includes a handle attachment means, for attachment to standard handles, including telescoping poles.

13 Claims, 5 Drawing Sheets

Fig. 5
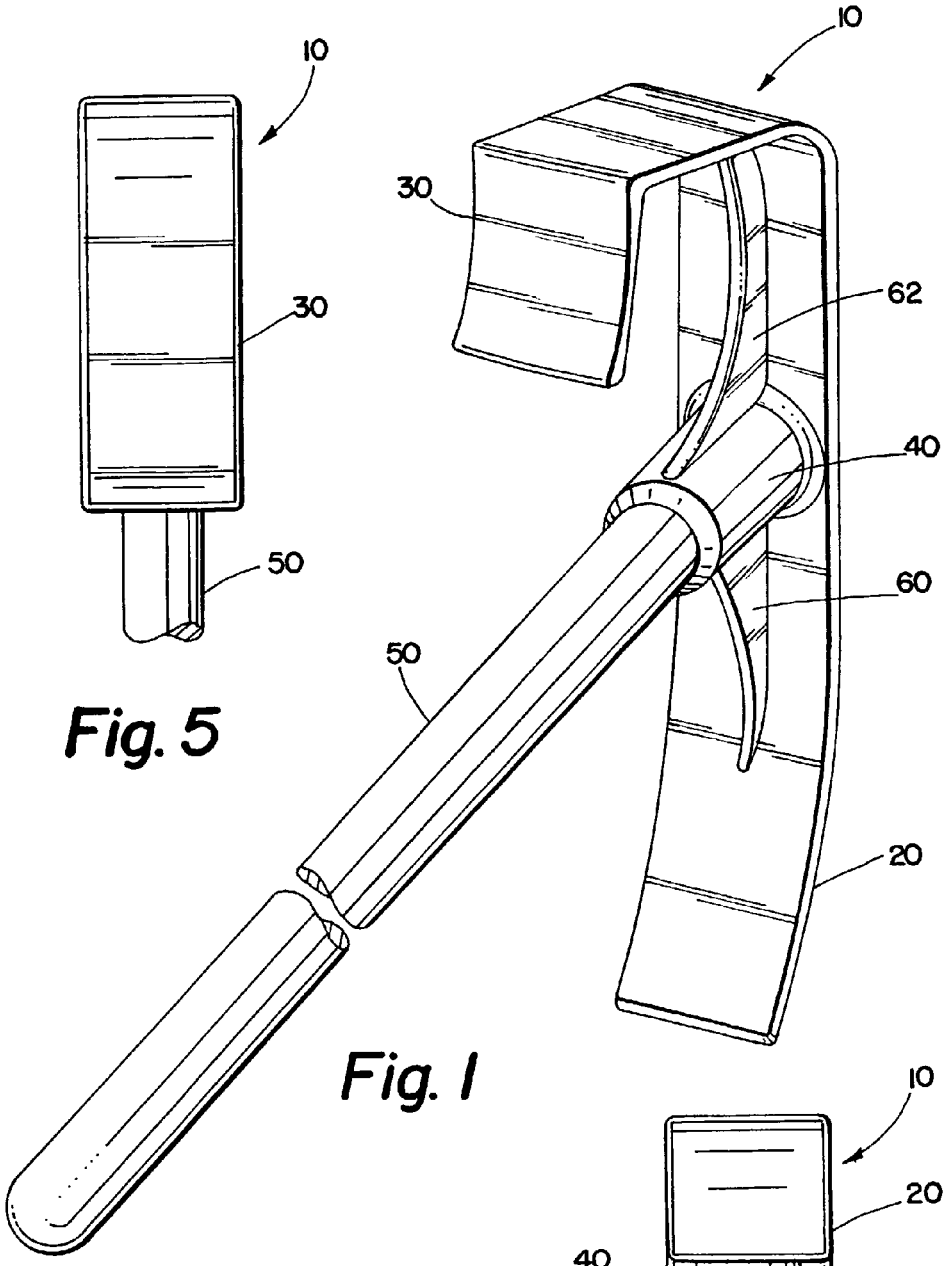
Fig. 1
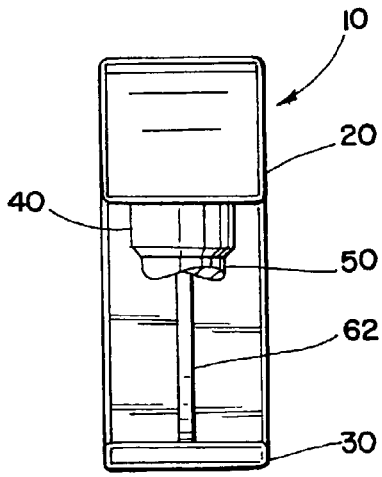
Fig. 6

GUTTER CLEANING TOOL

RELATED APPLICATIONS

Except for claims 8–13 and 17–19, this application claims priority from U.S. Ser. No. 60/323,915, filed on Sep. 20, 2001.

BACKGROUND OF THE INVENTION

1. Field of the Invention

This invention relates to tools for cleaning leaves and other debris from gutters.

2. General Background

Leaves and other debris often clog gutters, blocking water flow, and preventing the gutter from properly performing. Devices have been developed to help clear debris from gutters, ranging from very simple tools to complex vacuum-operated devices.

However, conventional gutter cleaning tools often fail to take into account the gutter strut or nail that attaches the gutter to the building. Conventional gutter tools can adequately pull or drag debris along the length of the gutter. But when they encounter the gutter strut, conventional tools must be lifted out of the gutter and placed on the opposite side of the strut, thus leaving stranded debris under the strut. This stranded debris can block the flow of water through the gutter.

Also, many conventional gutter tools are awkward or difficult to operate. For instance, the gutter tool described in U.S. Pat. No. 4,194,780 to Dilley is designed to address the problem of gutter struts, but is awkward to use because of the shape and orientation of its debris-trapping paddles. Thus, there is a need for a tool that can be easily operated by a person working at, above, or even below the level of the gutter.

Relatedly, there is a need for a gutter cleaning tool that fits easily in the gutter. Past gutter tools have been sized to conform exactly to the dimensions of the gutter, making insertion of the tool into the gutter difficult. See Dilley at FIG. 3.

SUMMARY OF THE INVENTION

The present invention is a gutter cleaning tool that can effectively clean under gutter struts, and that is easy to use and operate, even for those working above the gutter on the rooftop. It includes a body having (i) a handle attachment means, (ii) a curved blade for use in sections of the gutters that are unobstructed by a gutter strut, and (iii) a shovel blade for use under gutter struts. When combined with a handle, especially a telescoping pole, the present invention can be used to clean extended sections of a gutter without the need for repositioning.

BRIEF DESCRIPTION OF THE DRAWINGS

FIG. 1 is a perspective view of an embodiment of a gutter cleaning tool according to the present invention.

FIG. 5 is a front view of an embodiment of a gutter cleaning tool according to the present invention.

FIG. 6 is a back view of an embodiment of a gutter cleaning tool according to the present invention.

DETAILED DESCRIPTION

Figure 2:
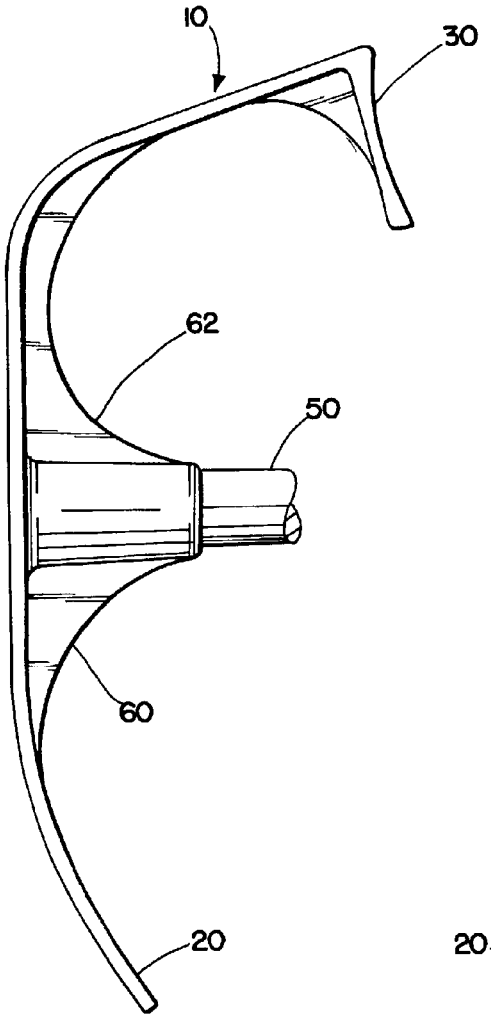
FIG. 2 is a side view of an embodiment of a gutter cleaning tool according to the present invention.
Figure 3:
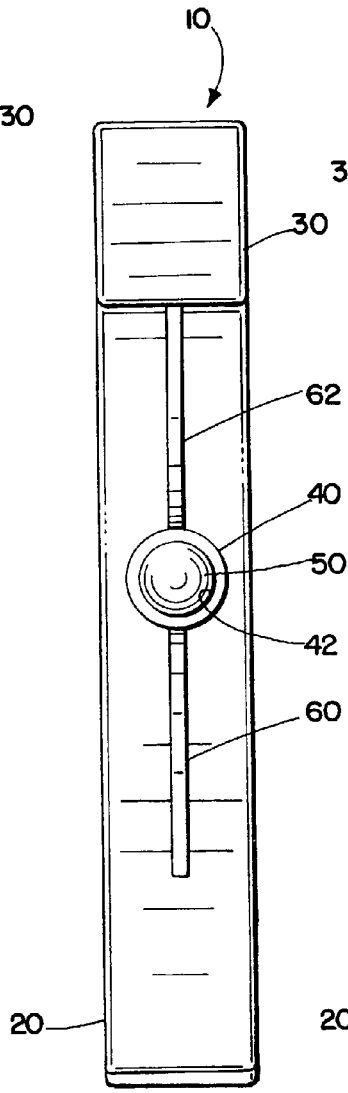
FIG. 3 is a top view of an embodiment of a gutter cleaning tool according to the present invention.
Figure 4:
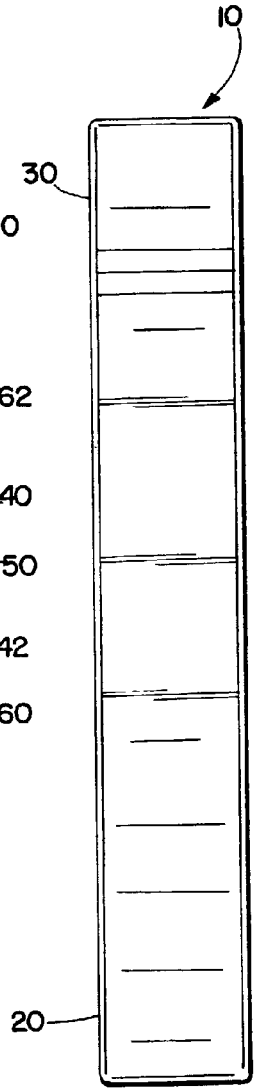
FIG. 4 is a bottom view of an embodiment of a gutter cleaning tool according to the present invention.

The present invention is a gutter tool comprised of a body 10 having a handle attachment means 40, a curved blade 20, and a shovel blade 30.

The handle attachment means can take a number of forms, including a handle receiving boss 40 as shown in FIGS. 1, 3, 7, 8, and 11. The handle receiving boss can have internal threads 42 for receiving a handle. In one embodiment, the threads are of a standard ⅝ inch size. Other conventional means can be used to attach a handle to the tool, including but not limited to brackets, screws, nails, adhesives, etc.

Figure 10:
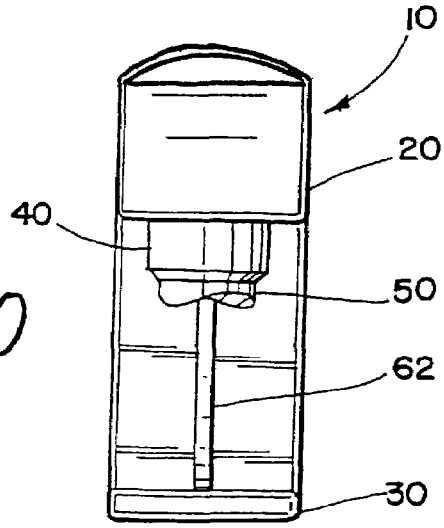
FIG. 10 is a back view of an alternative embodiment of a gutter cleaning tool according to the present invention, with a rounded bottom.
Figure 11:
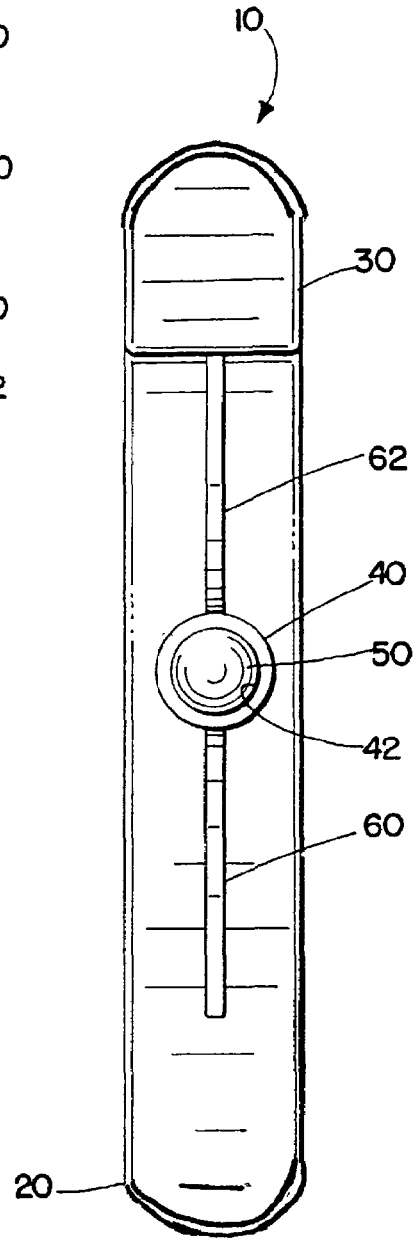
FIG. 11 is a top view of an alternative embodiment of a gutter cleaning tool according to the present invention, with rounded blade edges.

The curved blade 20 extends from the handle attachment means to one end of the body, as shown in FIGS. 1, 2, 7 and 8. The curved blade can be crescent-shaped, as shown in these figures, or can be other shapes. The back side of the blade, opposite the handle attachment means, can be rounded, as in FIG. 10, or flat, as shown in FIG. 6. The curved blade can have a rib 60 or ribs. See FIGS. 1, 2, 3, 7, and 11. The end of the blade can be form right angles, as in FIGS. 1, 3, and 7, or can be rounded or tapered, as shown in FIG. 11.

Figure 8:
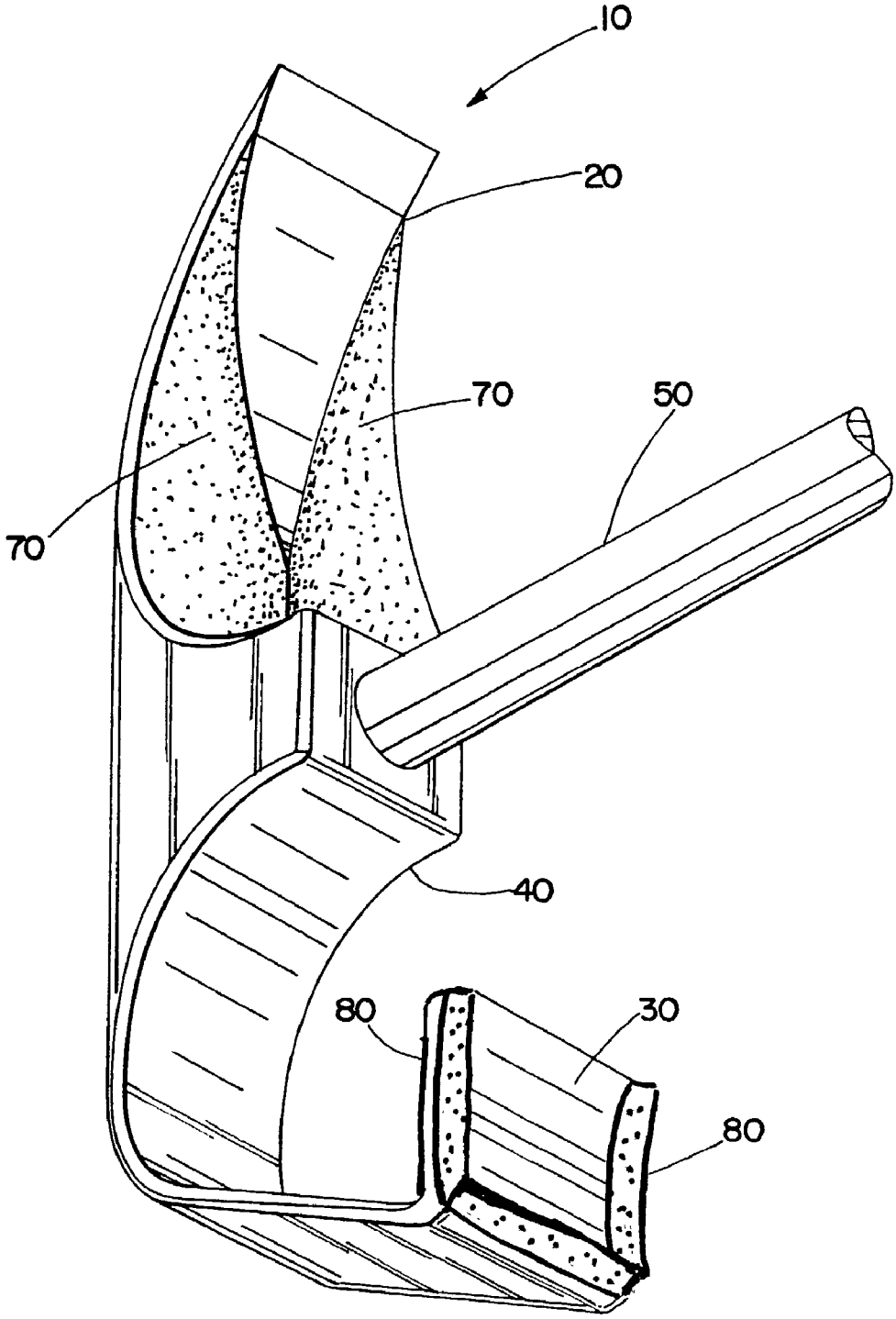
FIG. 8 is a perspective view of an alternative embodiment of a gutter cleaning tool according to the present invention.
Figure 9:
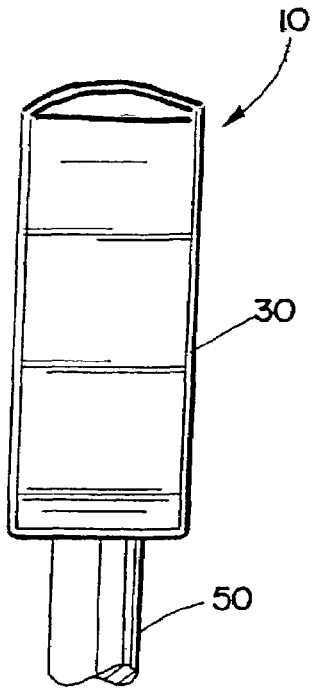
FIG. 9 is a front view of an alternative embodiment of a gutter cleaning tool according to the present invention, with a rounded bottom.

An arm extends from the handle receiving boss 40 to the shovel blade 30, as shown best in FIGS. 1, 2, and 8. The arm may be bent into an upper portion, adjacent to the handle receiving boss 40, and a lower portion, adjacent to the shovel blade 30. In one embodiment, the angle formed by this bend is obtuse, as shown in FIG. 2, so that the shovel blade can easily descend into the gutter, even if the operator of the tool is standing at or below the level of the gutter. The back side of the arm, opposite the handle attachment means, can be rounded, as in FIG. 9, or flat, as shown in FIG. 5.

Figure 7:
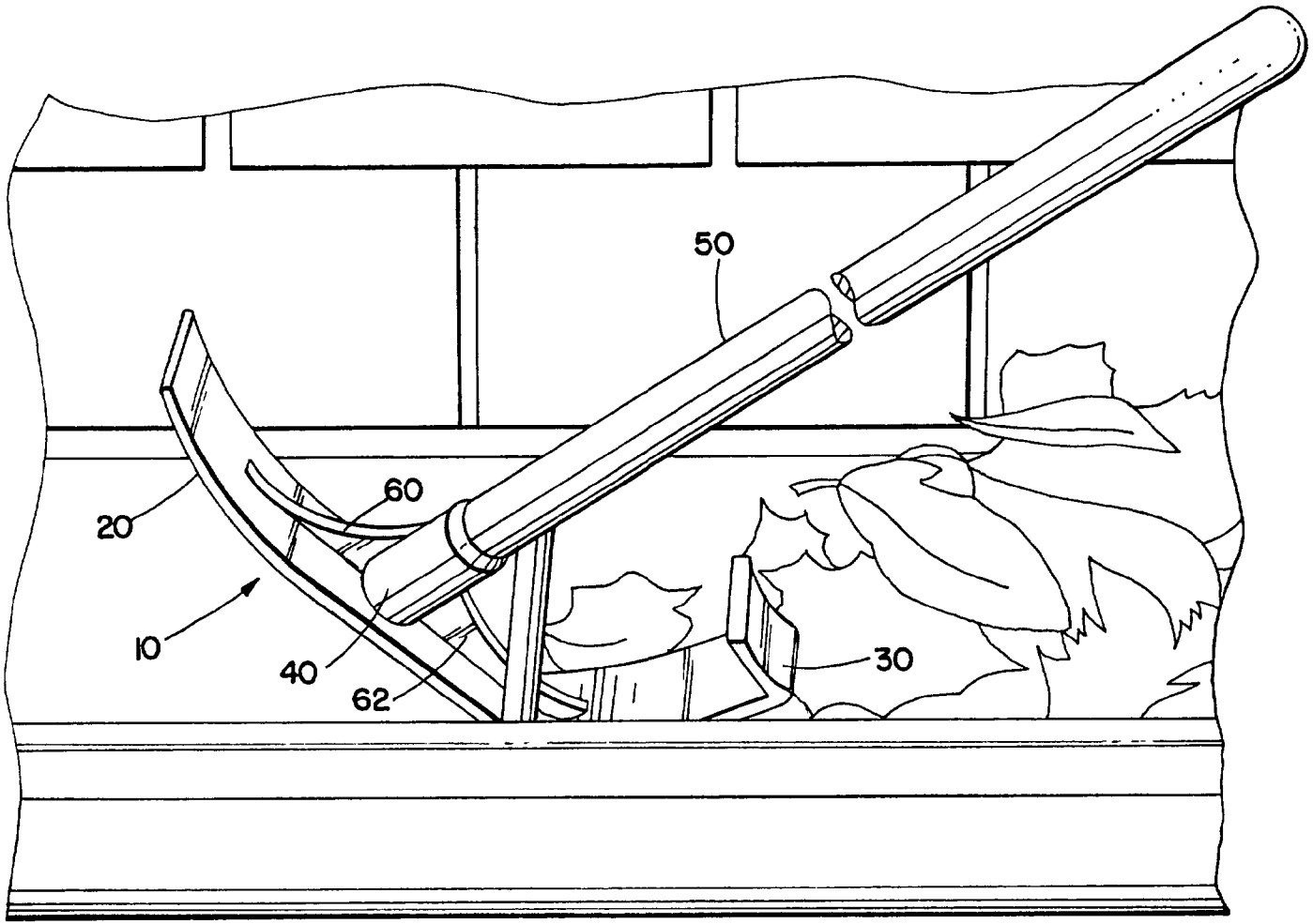
FIG. 7 is an environmental depiction of a gutter cleaning tool according to the present invention.

The shovel blade 30 is used to push debris under the gutter strut, as shown in FIG. 7. In one embodiment, the shovel blade is rectangularly shaped, see FIGS. 1, 3, and 7, although other shapes can be used. In particular, the two corners of the shovel blade nearest to the arm can be rounded or tapered, as shown in FIG. 11. As shown in FIG. 2, in one embodiment the shovel blade is planoconcave, although it could take a number of other forms, including but not limited to flat on both sides, or concave on both sides.

Sidewalls can be added to the curved blade 70 or to the shovel blade 80. See FIG. 8. When such sidewalls are used, they help trap debris.

Ribs 60, 62 can also be added to the curved blade and the arm/shovel blade, as shown in FIG. 2. These ribs, which are optional, add support.

In operation, a user would place the curved blade in a gutter, and pull the tool towards himself, collecting debris as he goes. Upon reaching a gutter strut, the tool is lifted out of the gutter, backed up slightly to provide clearance, and then rotated 180 degrees, thereby placing the shovel blade above the gutter. The shovel blade is then dropped into the gutter, and is used to push the debris under the strut. See FIG. 7. After clearing the area under the strut, the operator can continue using the curved blade.

In one embodiment, the curved blade and the shovel blade are sized so as to be substantially smaller than the width of a standard gutter. For instance, in one embodiment, the width of the curved blade and the width of the shovel blade are both less than 1.6 inches. By making the blades substantially smaller than the width of the gutter, it is easier for the operator to place the blade in the gutter. Put another way, a blade sized to conform exactly to the width of the gutter would be difficult to insert into the gutter, especially when the blade is on the end of a long pole. Also, by keeping the blade width small, the present invention can be used with non-standard gutter configurations. Except where the claims of this patent expressly so provide, the present invention is not limited to any particular dimensions.

The present invention can be made from any number of suitable materials, including plastic, wood, metal, etc. It can be made by a number of methods, including but not limited to injection molding or other conventional methods.

One skilled in the art will appreciate that the present invention can be practiced by other than the preferred embodiments, which are presented for purposes of illustration and not of limitation.

I claim:

1. A gutter cleaning tool, comprising:

a handle;

a planoconcave shovel blade attached to said handle through a handle attachment means;

a curved blade attached to said handle through said handle attachment means;

an arm intermediate between said planoconcave shovel blade and said handle attachment means; and wherein said arm is bent into an upper portion, proximate to said handle attachment means, and a lower portion, proximate to said planoconcave shovel blade, and an angle is formed between said upper portion and said lower portion, and said angle is obtuse.

2. The gutter cleaning tool according to claim 1, wherein said handle attachment means is a handle receiving boss.

3. The gutter cleaning tool according to claim 2, wherein said handle receiving boss has a bore for receiving a handle, and wherein said bore has threads.

4. The gutter cleaning tool according to claim 3, additionally comprising sidewalls on said curved blade.

5. The gutter cleaning tool according to claim 4, additionally comprising sidewalls on said shovel blade.

6. The gutter cleaning tool according to claim 5, additionally comprising a first rib on said curved blade.

7. The gutter cleaning tool according to claim 6, additionally comprising a second rib on said arm.

8. The gutter cleaning tool according to claim 7, wherein said curved blade has a first width, and wherein said first width is less than 1.6 inches.

9. The gutter cleaning tool according to claim 8, wherein said shovel blade has a second width, and wherein said second width is less than 1.6 inches.

10. A gutter cleaning tool, comprising:

a body, said body having a middle portion, a first end, and a second end;

a curved blade on said first end;

a handle receiving boss on said middle portion, said handle receiving boss having a bore with threads;

an arm, said arm extending from the handle receiving boss to the second end;

a shovel blade attached to the arm on said second end wherein said shovel blade is planoconcave; and wherein said arm is bent into an upper portion, proximate to said handle receiving boss, and a lower portion, proximate to said planoconcave shovel blade, and an angle is formed between said upper portion and said lower portion, and said angle is obtuse.

11. The gutter tool according to claim 10, wherein said body has a bottom portion, and wherein said bottom portion is rounded.

12. The gutter tool according to claim 11, wherein said curved blade has an end distal from said handle receiving boss, and said end is rounded.

13. The gutter tool according to claim 12, wherein said shovel blade has an end adjacent to said arm, and wherein said end is rounded.

* * * * *

UNITED STATES PATENT AND TRADEMARK OFFICE

CERTIFICATE OF CORRECTION

PATENT NO. : 7,076,828 B2
APPLICATION NO. : 10/223253
DATED : July 18, 2006
INVENTOR(S) : Mark Hewlett It is certified that error appears in the above-identified patent and that said Letters Patent is hereby corrected as shown below:

Title Page item [74]
The first named attorney's name is misspelled. The attorney's last name Temmerman has been misspelled as "Temmermar". The "r" should be changed to an --n--.

Signed and Sealed this

Fourteenth Day of November, 2006

JON W. DUDAS
*Director of the United States Patent and Trademark Office*